United States Patent [19]

Onogi et al.

[11] Patent Number: 4,681,082

[45] Date of Patent: Jul. 21, 1987

[54] IGNITION SYSTEM FOR INTERNAL COMBUSTION ENGINE

[75] Inventors: Nobuyoshi Onogi; Mamoru Shimamoto, both of Nagoya, Japan

[73] Assignee: Nippondenso Co., Ltd., Kariya, Japan

[21] Appl. No.: 726,464

[22] Filed: Apr. 24, 1985

[30] Foreign Application Priority Data

May 2, 1984 [JP] Japan ..... 59-88891

[51] Int. Cl.[4] ..... F02P 1/00

[52] U.S. Cl. ..... 123/643; 123/489

[58] Field of Search ..... 123/643, 479, 630

[56] References Cited

U.S. PATENT DOCUMENTS

| | | | |
|---|---|---|---|
| 4,112,895 | 9/1978 | Habert | 123/643 |
| 4,256,072 | 3/1981 | Nakatomi et al. | 123/643 |
| 4,485,784 | 12/1984 | Fujii | 123/643 |
| 4,499,875 | 2/1985 | Katayama | 123/643 |
| 4,502,441 | 3/1985 | Katayama | 123/643 |
| 4,502,454 | 3/1985 | Hamai | 123/489 |

FOREIGN PATENT DOCUMENTS

| | | | |
|---|---|---|---|
| 57-83667 | 5/1982 | Japan | 123/643 |
| 1464294 | 2/1977 | United Kingdom | 123/643 |

*Primary Examiner*—Ronald B. Cox

*Attorney, Agent, or Firm*—Cushman, Darby & Cushman

[57] ABSTRACT

An ignition system for controlling the distribution of ignition signals among a plurality of cylinders of a multi-cylinder internal combustion engine. An ignition timing signal and a BCD code signal obtained by counting (3) the cylinder discrimination signal generated at predetermined intervals of crank angle in accordance with the engine speed and a default signal produced at the time of a trouble with the ignition system are applied to a distribution ROM (5). The ROM, in turn, applies an ignition timing signal to each cylinder on the basis of stored data in accordance with the combination of these input signals. A fixed-position ignition is established at the time of a trouble.

3 Claims, 5 Drawing Figures

IGNITION SYSTEM FOR INTERNAL COMBUSTION ENGINE

The present invention relates to an ignition system for an internal combustion engine, or more particularly to a control of ignition signal distribution among cylinders.

Conventional multi-cylinder ignition advance-angle control systems have a problem that the circuit configurations of their-printed circuit boards must be changed according to the type of input pulses or the number of output cylinders in order to distribute ignition signals. (see, e.g., Japanese Patent Publication No. 83667/82).

For the purpose of obviating this problem, there is provided according to the present invention an ignition system for an internal combustion engine comprising means for computing the ignition timing in accordance with the operating conditions of the internal combustion engine and means for distributing the signal representing the ignition timing among the cylinders, wherein the distribution means includes a counter for counting the signals produced at intervals of a predetermined crank angle and a ROM (read-only memory) for allotting or distributing the signal representing the ignition timing to the cylinders determined in accordance with the output of the counter.

According to the present invention, the counter and the ROM are used for distributing the ignition signals, whereby an input type of various ratios between G (reference signal) and N (cylinder discrimination signal) or various output types (number of cylinders, DLi system, coil system or CDi system) can be easily employed. In the case of using a microcomputer as the operating means, addition of microcomputer functions and the reduction of the microcomputer load for the signal distribution among cylinders are facilitated, and yet spark ignitions at uneven time intervals can be easily caused, for example, for a V type internal combustion engine.

Further objects, features and advantages of the invention will be apparent from the following description with reference to the accompanying drawings, in which.

The present invention will be explained below with reference to an embodiment thereof.

Figure 1:
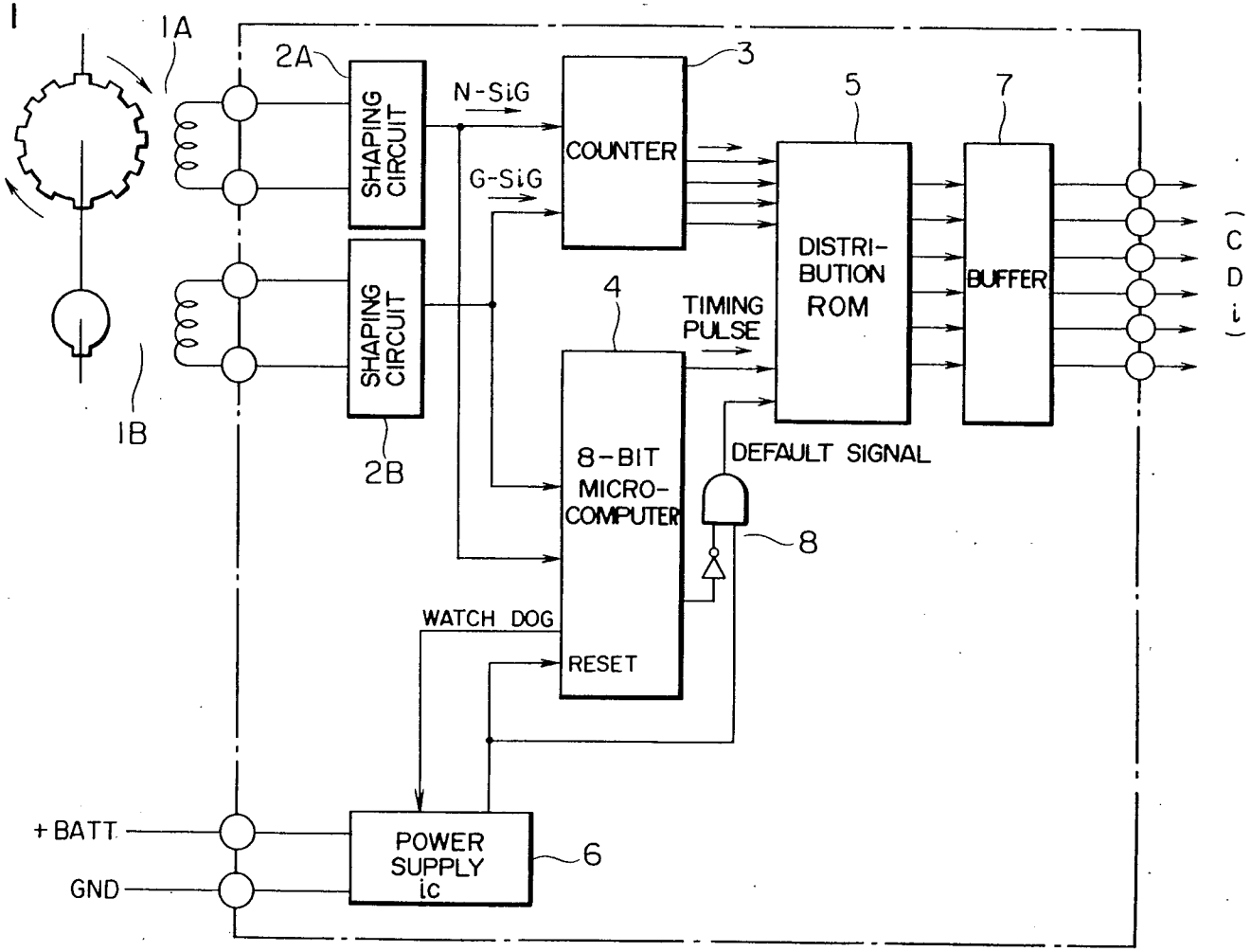
FIG. 1 is a diagram showing a general configuration according to an embodiment of the present invention.

A general configuration of the invention is shown in FIG. 1. Reference numeral 1A designates a magnetic pickup sensor for producing a cylinder discrimination signal (N signal), and numeral 1B a magnetic pickup sensor for producing a reference signal. Numerals 2A, 2B designate shaping circuits using an operational amplifier, and numeral 3 a binary counter supplied with signals from the shaping circuits 2A, 2B. A counter such as TC4520 of Toshiba is used for this purpose. Numeral 4 designates a 8-bit microcomputer such as 6803-W2 of Fujitsu. Numeral 5 designates a ROM for distribution control, such as 2716 of Fujitsu. Numeral 6 designates a power supply IC providing a 5 V constant-voltage power supply with fail-safe reset function. Numeral 7 designates an output buffer including six transistors. Numeral 8 designates a logic circuit including an AND gate and an inverter.

The operation of this circuit having the above-mentioned configuration will be described. The magnetic pickups 1A and 1B produce an N signal making up a cylinder discrimination signal and a G signal making up a reference signal respectively. These signals are applied through the shaping circuits 2A and 2B to the binary counter 3 and the microcomputer 4 respectively. The counter 3, as shown in the timing chart of FIG. 2, counts the rises of the N signal at crank angle intervals of 60° CA, and is cleared at the fall points of the G signal at crank angle intervals of 720° CA. The counter value thus takes the form of BCD code from O to B (=11).

Figure 2:
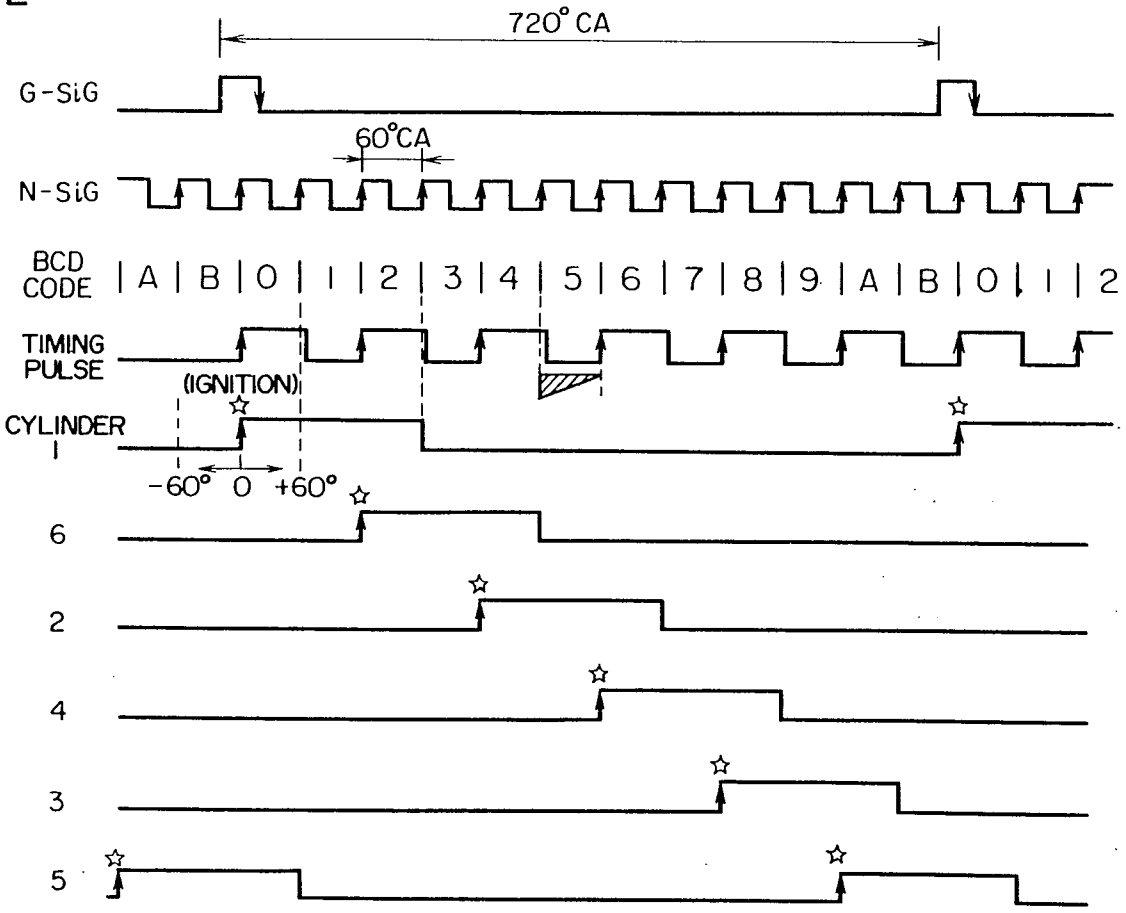
FIG. 2 is a timing chart for explaining the operation of the same embodiment.
Figure 4:
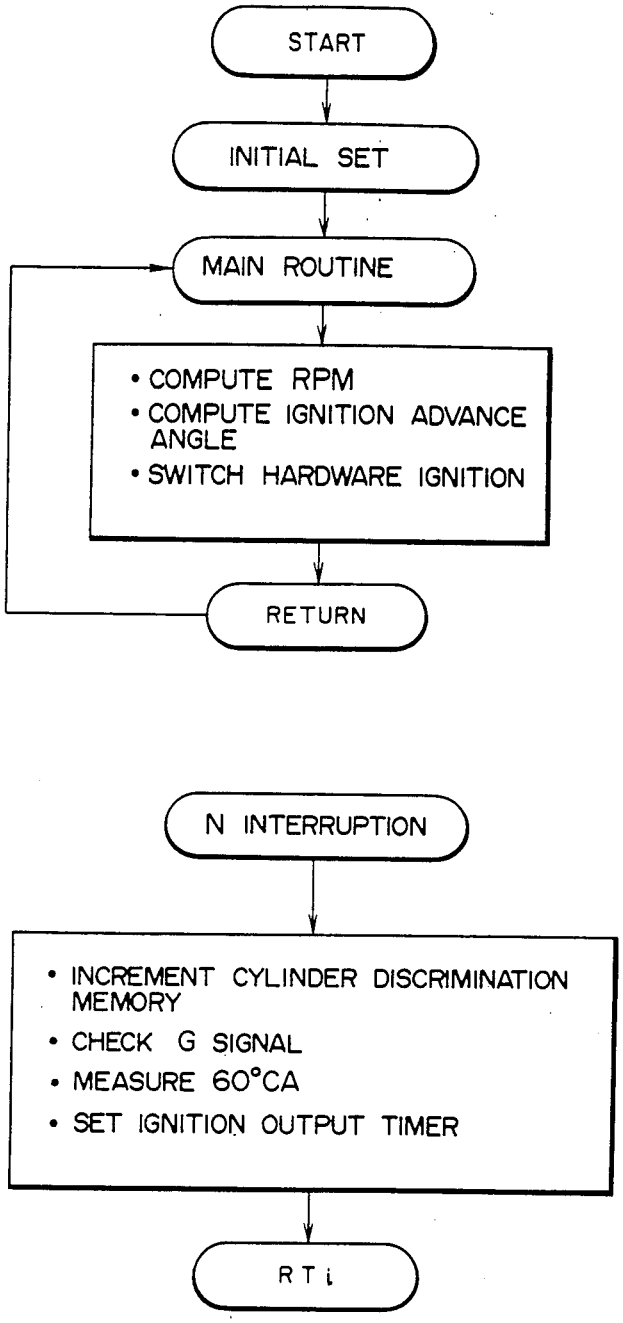
FIG. 4 is a flowchart showing the processing steps according to the same embodiment.

The microcomputer 4 captures and counts the N signal at the rise thereof by an input capture interruption as shown routine of the N interruption in FIG. 4, while at the same time measuring the crank angle of 60° CA providing N signal intervals. Further, the microcomputer 4, as shown by the main routine in FIG. 4, determines the engine speed from the rotation time associated with 60° CA, whereby the amount of ignition advance is determined. This value is set to a timer at intervals of 120° CA by the N interruption thereby to determine an ignition timing. A timing pulse as shown in FIG. 2 is thus obtained. The microcomputer 4 also keeps pulses (watch-dog signal) applied to the power supply IC 6 at intervals of 4 msec. If this signal is stopped, the microcomputer is assumed to have encountered a trouble and the power supply IC 6 is reset. Further, the microcomputer 4 supplies a "1" signal to the inverter of the logic circuit 8 when the engine speed is reduced below 500 rpm or increased beyond 13000 rpm. Specifically, the AND gate produces a "0" signal to attain a fixed-position ignition when the microcomputer encounters a trouble or the engine speed is from 0 to 500 rpm or more than 13000 rpm.

Figure 3:
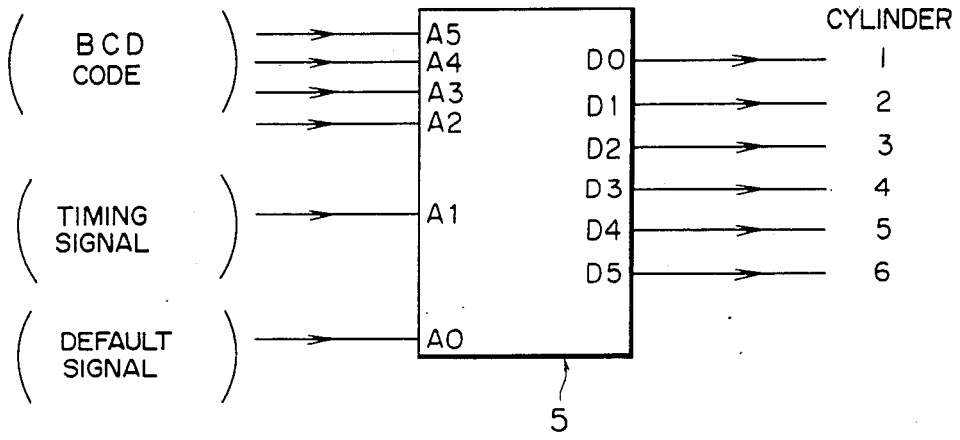
FIG. 3 is a diagram showing the details of the ROM in FIG. 1.

The distribution ROM, as shown in FIG. 3, receives a BCD code signal, timing pulse and default signal on an address side, and has the data written therein in such a manner that signals as shown in the timing chart of FIG. 2 (for cylinders 1, 6, 2, 4, 3 and 5) are selectively produced in accordance with the BCD code signal and the timing pulse. The cases of writing data are divided by use of the three signals of BCD code, timing pulse and default signal, and an object data to be written in the ROM is prepared in this preferred embodiment by FORTRAN language. The buffer 7 is for producing a sufficient output current and includes a transistor.

According to the present invention, the port load is lightened since only one output port of the microcomputer 4 is sufficient for the purpose of ignition timing.

Figure 5:
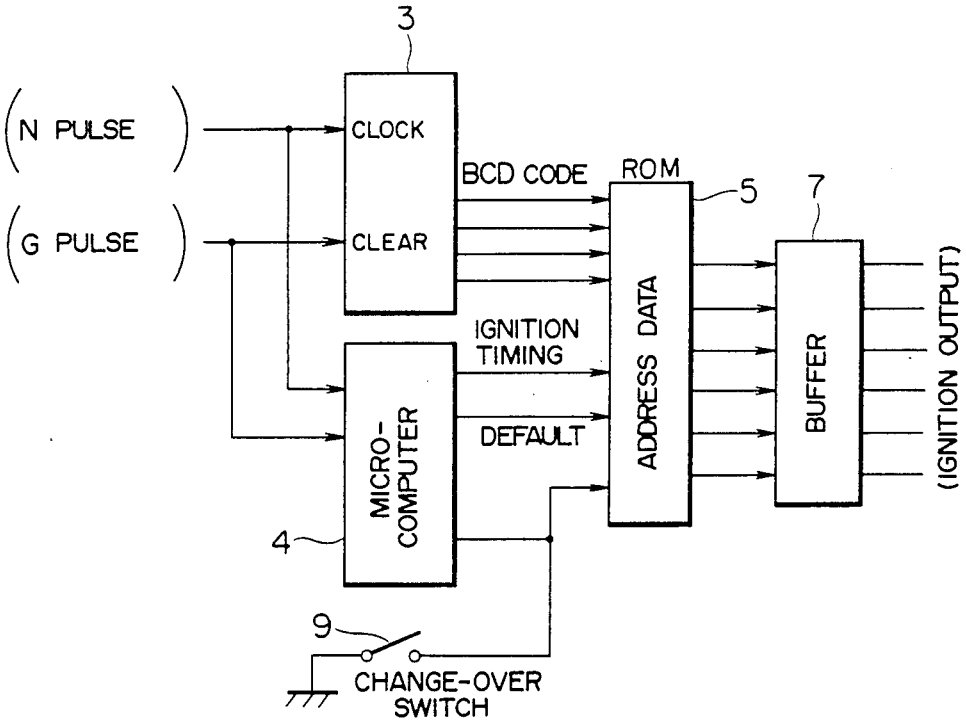
FIG. 5 is a diagram showing a configuration of the essential parts according to another embodiment of the present invention.

Further, according to the present invention, various specifications or demands of design or can be satisfied by changing the program of the microcomputer and the distribution ROM 5 with the same circuit. A circuit embodying this idea is shown in FIG. 5. In this circuit, a mode change-over switch 9 is added for switching between the modes for the sensor and output type in the manner shown in Tables 1 and 2. Specifically, when the switch is turned on, six cylinders and CDi ignition are involved, while when the switch is turned off, four cylinders and coil ignition are involved, whereby the same ECU (electronic control unit) can be used for various types of cars.

TABLE 1

| | Switching for sensor | |
|---|---|---|
| | N pulse | G pulse |
| ON | 12 | 1 |
| OFF | 8 | 1 |

TABLE 2

| | Switching for output type | |
|---|---|---|
| | Number of cylinders | output type |
| ON | 6 | CDi ignition |
| OFF | 4 | Coil ignition |

It will be thus understood from the foregoing description that, according to the present invention, a counter and a ROM are used for the purpose of distributing computed ignition signals among the cylinders, with the result that spark ignitions at uneven time intervals can be easily caused and that any change in the type of input pulse or the number of output cylinders can be easily compensated for. Further, a fixed ignition signal can be applied to the counter and ROM alone when the operating means encounter a trouble at the time of ignition.

We claim:

1. An ignition control system for an internal combustion engine, comprising:

means for detecting engine operating conditions to produce operating condition signals indicative thereof at predetermined intervals of engine crank angle;

means for computing engine ignition timing in response to the operating condition signals to produce an ignition timing deciding sinal;

means for selectively distributing an ignition timing signal to engine cylinders in response to the operating condition signals and the ignition timing deciding signal, including counter means for counting the predetermined interval signals to produce count output signals, and read-only memory means, having address input terminals and output terminals, for: (1) receiving the count output signals and the ignition timing deciding signal, (2) having data present at locations therein corresponding to the signals, (3) reading out a cylinder data corresponding to the received count output signal, and (4) distributing the ignition timing signal through one of the output terminals thereof to a corresponding one of the cylinders, which one cylinder corresponds to the read out cylinder data;

reference position sensor means for generating a reference position signal at a specific angular position per every two revolutions of the engine; and angular position sensor means for generating angular signals, equal in number to an integral multiple of a number of the cylinders, per every two revolutions of the engine, wherein said counter means is cleared by said reference position signal to count angular signals of said angular position sensor means wherein said read-only memory means includes data which produces the ignition timing signal through one of the output terminals for the distribution to the corresponding cylinder in response to the ignition timing deciding signal for said computing means, and includes data which stops the produced ignition timing signal after a given number of the counting operations of said counter means.

2. An ignition control system for an internal combustion engine, comprising:

means for detecting engine operating conditions to produce operating condition signals indicative thereof at predetermined intervals of engine crank angle;

means for computing engine ignition timing in response to the operating condition signals to produce an ignition timing deciding signal; and means for selectively distributing an ignition timing signal to engine cylinderss in response to the operating condition signals and the ignition timing deciding signal, including counter means for counting the predetermined interval signals to produce count output signals, and read-only memory means, having address input terminals and output terminals, for: (1) receiving the count output signals and the ignition timing deciding signal, (2) having data preset at locations therein corresponding to the signals, (3) reading out a cylinder data corresponding to the received count output signal, and (4) distributing the ignition timing signal through one of the output terminals thereof to a corresponding one of the cylinders, which one cylinder corresponds to the read out cylinder data;

wherein said read-only memory means includes data for use with different engines having different numbers of cylinders, said system having a mode changing switch, operatively connected to a further address input terminal of said read-only memory means for enabling data for any one of the different cylinders according to the switch operation.

3. A system according to claim 1, wherein said read-only memory means includes data which produces a current ignition timing signal for a current one of the cylinders and produces a next ignition timing signal for a next one of the cylinders before the stop of the current ignition timing signal.

* * * * *